US011441319B2

(12) United States Patent
Boucké et al.

(10) Patent No.: US 11,441,319 B2
(45) **Date of Patent: *Sep. 13, 2022**

(54) PANEL AND COVERING

(71) Applicant: I4F Licensing NV, Hamont-Achel (BE)

(72) Inventors: Eddy Alberic Boucké, Menen (BE); Johan Christiaan Rietveldt, Best (NL)

(73) Assignee: I4F Licensing NV, Hamont-Achel (BE)

( * ) Notice: Subject to any disclaimer, the term of this patent is extended or adjusted under 35 U.S.C. 154(b) by 0 days.

This patent is subject to a terminal disclaimer.

(21) Appl. No.: 17/155,902

(22) Filed: Jan. 22, 2021

(65) Prior Publication Data

US 2021/0140178 A1 May 13, 2021

Related U.S. Application Data

(63) Continuation of application No. 16/606,938, filed as application No. PCT/NL2018/050272 on Apr. 26, 2018, now Pat. No. 10,947,741.

(30) Foreign Application Priority Data

Apr. 26, 2017 (NL) ..... 2018781

(51) Int. Cl.
*E04B 2/00* (2006.01)
*E04F 15/02* (2006.01)

(52) U.S. Cl.
CPC ..... *E04F 15/02038* (2013.01); *E04F 2201/0146* (2013.01); *E04F 2201/041* (2013.01)

(58) Field of Classification Search
CPC ..... E04F 2201/0146; E04F 2201/041; E04F 15/02038
USPC ..... 52/588.1
See application file for complete search history.

(56) References Cited

U.S. PATENT DOCUMENTS

| | | | |
|---|---|---|---|
| 792,979 | A | 6/1905 | Fulghum |
| 3,082,488 | A | 3/1963 | Nusbaum |
| 3,428,471 | A | 2/1969 | Tuthill et al. |
| 3,514,393 | A | 5/1970 | Eisby |
| 3,650,549 | A | 3/1972 | Pepper |
| 3,723,220 | A | 3/1973 | Scher et al. |
| 3,870,591 | A | 3/1975 | Witman |
| 3,921,312 | A | 11/1975 | Fuller |
| 4,018,957 | A | 4/1977 | Werner et al. |
| 4,113,909 | A | 9/1978 | Beasley |
| 4,136,224 | A | 1/1979 | Minami et al. |
| 4,164,389 | A | 8/1979 | Beasley |
| 4,180,615 | A | 12/1979 | Bettoli |
| 4,242,390 | A | 12/1980 | Nemeth |
| 4,296,582 | A | 10/1981 | Simpson et al. |

(Continued)

FOREIGN PATENT DOCUMENTS

| | | |
|---|---|---|
| BE | 557844 | 6/1957 |
| CA | 2363184 A1 | 7/2001 |

(Continued)

*Primary Examiner* — Basil S Katcheves
(74) *Attorney, Agent, or Firm* — The Webb Law Firm

(57) ABSTRACT

Interconnectable panels, such as interconnectable floor panels, are generally joined mechanically at edges of the panels by using complementary coupling profiles at opposite edges. Traditionally, rectangular floor panels are connected at the long edges by means of a traditional angling method. The invention relates to an interconnectable panel, in particular a floor panel.

12 Claims, 5 Drawing Sheets

(56) References Cited

U.S. PATENT DOCUMENTS 4,312,686 A 1/1982 Smith et al.
4,315,050 A 2/1982 Rourke
4,329,307 A 5/1982 Westcott et al.
4,337,321 A 6/1982 Allada
4,393,187 A 7/1983 Boba et al.
4,426,820 A 1/1984 Terbrack et al.
4,449,346 A 5/1984 Tremblay
4,456,643 A 6/1984 Colyer
4,457,120 A 7/1984 Takata
4,571,353 A 2/1986 Gable, Jr.
4,599,264 A 7/1986 Kauffman et al.
4,644,720 A 2/1987 Schneider
4,689,259 A 8/1987 Miller, Jr. et al.
4,696,132 A 9/1987 LeBlanc
4,698,258 A 10/1987 Harkins, Jr.
4,707,393 A 11/1987 Vetter
4,710,415 A 12/1987 Slosberg et al.
4,801,495 A 1/1989 van der Hoeven
4,865,807 A 9/1989 Petershofer et al.
4,935,286 A 6/1990 Witman
4,940,503 A 7/1990 Lindgren et al.
5,022,200 A 6/1991 Wilson et al.
5,050,653 A 9/1991 Brown
5,066,531 A 11/1991 Legg et al.
5,103,614 A 4/1992 Kawaguchi et al.
5,122,212 A 6/1992 Ferguson et al.
5,182,892 A 2/1993 Chase
5,183,438 A 2/1993 Blom
5,274,979 A 1/1994 Tsai
5,277,852 A 1/1994 Spydevold
5,303,526 A 4/1994 Niese
5,349,796 A 9/1994 Meyerson
5,425,986 A 6/1995 Guyette
5,458,953 A 10/1995 Wang et al.
5,547,741 A 8/1996 Wilson
5,595,625 A 1/1997 Fishel et al.
5,627,231 A 5/1997 Shalov et al.
5,630,304 A 5/1997 Austin
5,643,677 A 7/1997 Feifer et al.
5,670,237 A 9/1997 Shultz et al.
5,681,652 A 10/1997 Cope
5,706,621 A 1/1998 Pervan
5,719,227 A 2/1998 Rosenberry et al.
5,747,133 A 5/1998 Vinod et al.
5,755,068 A 5/1998 Ormiston
5,780,147 A 7/1998 Sugahara et al.
5,791,144 A 8/1998 Thompson
5,797,237 A 8/1998 Finkell, Jr.
5,824,415 A 10/1998 Kanki et al.
5,830,937 A 11/1998 Shalov et al.
5,834,081 A 11/1998 Fanti
5,836,128 A 11/1998 Groh et al.
5,836,632 A 11/1998 Pompa
5,869,138 A 2/1999 Nishibori
5,901,510 A 5/1999 Ellingson
5,968,630 A 10/1999 Foster
5,985,429 A 11/1999 Plummer et al.
5,989,668 A 11/1999 Nelson et al.
6,006,486 A 12/1999 Moriau et al.
6,023,907 A 2/2000 Pervan
6,093,473 A 7/2000 Min
6,098,365 A 8/2000 Martin et al.
6,101,778 A 8/2000 Martensson
6,103,044 A 8/2000 Harwood et al.
6,131,355 A 10/2000 Groh et al.
6,228,463 B1 5/2001 Chen et al.
6,250,040 B1 6/2001 Green
6,324,809 B1 12/2001 Nelson
6,333,076 B1 12/2001 Sigel et al.
6,421,970 B1 7/2002 Martensson et al.
6,436,159 B1 8/2002 Safta et al.
6,449,918 B1 9/2002 Nelson
6,490,836 B1 12/2002 Moriau et al.
6,505,452 B1 1/2003 Hannig et al.
6,591,568 B1 7/2003 Palsson
6,617,009 B1 9/2003 Chen et al.
6,753,066 B2 6/2004 Eby et al.
6,766,622 B1 7/2004 Thiers
6,769,219 B2 8/2004 Schwitte et al.
6,874,292 B2 4/2005 Moriau et al.
6,880,307 B2 4/2005 Schwitte et al.
6,920,732 B2 7/2005 Martensson
6,928,779 B2 8/2005 Moriau et al.
6,955,020 B2 10/2005 Moriau et al.
7,003,364 B1 2/2006 Hansson et al.
7,121,058 B2 10/2006 Palsson et al.
7,127,860 B2 10/2006 Pervan et al.
7,211,310 B2 5/2007 Chen et al.
7,275,350 B2 10/2007 Pervan et al.
7,398,625 B2 7/2008 Pervan
7,419,717 B2 9/2008 Chen et al.
7,484,337 B2 2/2009 Hecht
7,617,651 B2 11/2009 Grafenauer
7,654,054 B2 2/2010 Moriau et al.
7,712,280 B2 5/2010 Moriau et al.
7,757,453 B2 7/2010 Moriau et al.
7,763,143 B2 * 7/2010 Boucke ..... E04F 15/02 156/304.5
7,763,345 B2 7/2010 Chen et al.
7,779,596 B2 * 8/2010 Pervan ..... E04F 15/02 52/588.1
7,810,297 B2 10/2010 Moriau et al.
7,874,119 B2 1/2011 Pervan et al.
7,896,571 B1 3/2011 Hannig et al.
7,958,689 B2 6/2011 Lei
7,980,043 B2 7/2011 Moebus
8,021,741 B2 9/2011 Chen et al.
8,038,363 B2 10/2011 Hannig et al.
8,091,238 B2 1/2012 Hannig
8,191,334 B2 6/2012 Braun
8,215,076 B2 7/2012 Pervan et al.
8,281,549 B2 10/2012 Du
8,365,499 B2 2/2013 Nilsson et al.
8,375,672 B2 2/2013 Hannig
8,544,231 B2 10/2013 Hannig
8,544,232 B2 10/2013 Wybo et al.
8,584,423 B2 11/2013 Pervan et al.
8,658,274 B2 2/2014 Chen et al.
8,689,512 B2 4/2014 Pervan
8,745,952 B2 6/2014 Perra et al.
8,756,899 B2 6/2014 Nilsson et al.
8,789,334 B2 7/2014 Moriau et al.
8,833,029 B2 9/2014 Grafenauer
8,834,992 B2 9/2014 Chen et al.
8,978,336 B2 3/2015 Perra et al.
9,169,657 B1 * 10/2015 Marek ..... E04F 15/02038
9,217,250 B2 12/2015 Perra et al.
9,249,581 B2 2/2016 Nilsson et al.
9,487,957 B2 11/2016 Cappelle
9,745,756 B2 8/2017 Hannig
9,874,028 B2 1/2018 Boucke et al.
10,053,868 B2 8/2018 Perra et al.
10,267,046 B2 4/2019 Boucke et al.
10,947,741 B2 * 3/2021 Boucke ..... E04F 15/02038
2002/0189183 A1 12/2002 Ricciardelli
2003/0019174 A1 1/2003 Bolduc
2003/0093964 A1 5/2003 Buchey et al.
2003/0154684 A1 * 8/2003 Becker ..... E04F 15/04 52/592.1
2004/0035080 A1 * 2/2004 Becker ..... F16B 5/0012 52/592.1
2004/0128934 A1 7/2004 Hecht
2004/0177584 A1 9/2004 Pervan
2004/0250492 A1 * 12/2004 Becker ..... E04F 15/04 52/578
2005/0028474 A1 2/2005 Kim
2005/0171246 A1 8/2005 Maine et al.
2005/0183370 A1 8/2005 Cripps
2006/0156666 A1 7/2006 Caufield
2006/0260253 A1 11/2006 Brice
2007/0130872 A1 6/2007 Goodwin et al.
2008/0034701 A1 2/2008 Pervan
2008/0134607 A1 6/2008 Pervan et al.
2009/0019808 A1 1/2009 Palsson et al.

(56) References Cited

U.S. PATENT DOCUMENTS

| | | | | |
|---|---|---|---|---|
| 2009/0126308 | A1 | 5/2009 | Hannig et al. | |
| 2009/0249733 | A1 | 10/2009 | Moebus | |
| 2009/0308014 | A1 | 12/2009 | Muehlebach | |
| 2010/0031594 | A1 | 2/2010 | Liu et al. | |
| 2010/0058702 | A1 | 3/2010 | Lei | |
| 2010/0218450 | A1* | 9/2010 | Braun | F16B 5/0056 52/588.1 |
| 2010/0293879 | A1* | 11/2010 | Pervan | E04F 15/02038 52/588.1 |
| 2011/0056167 | A1 | 3/2011 | Nilsson | |
| 2011/0131909 | A1* | 6/2011 | Hannig | E04F 15/02 52/309.1 |
| 2011/0138722 | A1 | 6/2011 | Hannig | |
| 2011/0162308 | A1* | 7/2011 | Park | B32B 7/12 52/309.3 |
| 2011/0167744 | A1* | 7/2011 | Whispell | B32B 5/245 52/309.1 |
| 2011/0247285 | A1* | 10/2011 | Wybo | B29C 66/12841 52/309.1 |
| 2011/0277406 | A1* | 11/2011 | Kang | E04F 15/22 52/309.3 |
| 2012/0174521 | A1* | 7/2012 | Schulte | E04F 15/02 52/588.1 |
| 2012/0266555 | A1 | 10/2012 | Cappelle | |
| 2013/0097959 | A1* | 4/2013 | Michel | E04F 15/02 52/588.1 |
| 2013/0309441 | A1 | 11/2013 | Hannig | |
| 2014/0150369 | A1 | 6/2014 | Hannig | |
| 2014/0165493 | A1 | 6/2014 | Palsson et al. | |
| 2014/0283477 | A1 | 9/2014 | Hannig | |
| 2015/0368912 | A1* | 12/2015 | Baert | E04F 13/077 52/309.15 |
| 2016/0047129 | A1* | 2/2016 | Bowers | E04F 15/22 16/16 |
| 2016/0069086 | A1* | 3/2016 | Hullenkremer | E04F 15/02016 52/588.1 |
| 2016/0177578 | A1* | 6/2016 | Ramachandra | E04F 15/041 52/588.1 |
| 2016/0186443 | A1 | 6/2016 | Perra et al. | |
| 2017/0328074 | A1 | 11/2017 | Hannig | |

FOREIGN PATENT DOCUMENTS

| | | | |
|---|---|---|---|
| CN | 2301491 | Y | 12/1998 |
| CN | 2361725 | Y | 2/2000 |
| CN | 101492950 | A | 7/2009 |
| DE | 2835924 | A1 | 2/1980 |
| DE | 4122099 | C1 | 10/1992 |
| DE | 9401365 | U1 | 4/1994 |
| DE | 4242530 | A1 | 6/1994 |
| DE | 29911462 | U1 | 12/1999 |
| DE | 19933343 | A1 | 2/2001 |
| DE | 29914604 | U1 | 2/2001 |
| DE | 20108941 | U1 | 9/2001 |
| DE | 20203311 | U1 | 6/2002 |
| DE | 20206751 | U1 | 9/2002 |
| DE | 10120062 | A1 | 11/2002 |
| DE | 10242647 | A1 | 6/2004 |
| DE | 10305695 | A1 | 9/2004 |
| DE | 202005004537 | U1 | 7/2005 |
| DE | 102005028072 | A1 | 12/2006 |
| DE | 102005059540 | A1 | 6/2007 |
| DE | 102006011887 | A1 | 7/2007 |
| DE | 202008006250 | U1 | 10/2008 |
| DE | 202008011589 | U1 | 1/2009 |
| DE | 102011086846 | A1 | 8/2012 |
| EP | 0040433 | A1 | 11/1981 |
| EP | 0085196 | A1 | 8/1983 |
| EP | 0214643 | A2 | 3/1987 |
| EP | 0548767 | A1 | 6/1993 |
| EP | 0592013 | A2 | 4/1994 |
| EP | 0890373 | A1 | 1/1999 |
| EP | 1026341 | A2 | 8/2000 |
| EP | 1097804 | A1 | 5/2001 |
| EP | 1108529 | A2 | 6/2001 |
| EP | 1223267 | A2 | 7/2002 |
| EP | 1165906 | B1 | 8/2002 |
| EP | 1243721 | A2 | 9/2002 |
| EP | 1304427 | A2 | 4/2003 |
| EP | 1308577 | A2 | 5/2003 |
| EP | 1338721 | A2 | 8/2003 |
| EP | 1359266 | A2 | 11/2003 |
| EP | 1367194 | A2 | 12/2003 |
| EP | 1394336 | A2 | 3/2004 |
| EP | 1396593 | A2 | 3/2004 |
| EP | 1190149 | B1 | 9/2004 |
| EP | 1282752 | B1 | 10/2004 |
| EP | 1512808 | A1 | 3/2005 |
| EP | 1159497 | B1 | 9/2005 |
| EP | 1589161 | A2 | 10/2005 |
| EP | 1612346 | A2 | 1/2006 |
| EP | 1631618 | A1 | 3/2006 |
| EP | 1490566 | B1 | 8/2006 |
| EP | 1585875 | B1 | 10/2006 |
| EP | 1570143 | B1 | 5/2007 |
| EP | 1518032 | B1 | 1/2008 |
| EP | 1938963 | A1 | 7/2008 |
| EP | 2009197 | A1 | 12/2008 |
| EP | 1276941 | B1 | 1/2009 |
| EP | 2031149 | A2 | 3/2009 |
| EP | 2077358 | A2 | 7/2009 |
| EP | 2248665 | A1 | 11/2010 |
| EP | 2390437 | A2 | 11/2011 |
| EP | 2407288 | A1 | 1/2012 |
| FR | 1175582 | | 3/1959 |
| FR | 1293043 | | 4/1962 |
| FR | 2416988 | | 9/1979 |
| FR | 2746127 | A1 | 9/1997 |
| FR | 2826391 | A1 | 12/2002 |
| FR | 2826392 | A1 | 12/2002 |
| GB | 816243 | | 7/1959 |
| GB | 1520964 | | 8/1978 |
| GB | 2216976 | A | 10/1989 |
| JP | 170939 | U | 5/1989 |
| JP | 324538 | U | 3/1991 |
| JP | H6117081 | A | 4/1994 |
| JP | 7300979 | A | 11/1995 |
| JP | H8270193 | A | 10/1996 |
| JP | H1144084 | A | 2/1999 |
| JP | 20024552 | A | 1/2002 |
| KR | 1020080096189 | A | 10/2008 |
| WO | 8200021 | A1 | 1/1982 |
| WO | 8801934 | A1 | 3/1988 |
| WO | 9413169 | A1 | 6/1994 |
| WO | 9417996 | A1 | 8/1994 |
| WO | 9421721 | A1 | 9/1994 |
| WO | 9517568 | A1 | 6/1995 |
| WO | 9604441 | A1 | 2/1996 |
| WO | 9627721 | A1 | 9/1996 |
| WO | 9747834 | A1 | 12/1997 |
| WO | 9844187 | A1 | 10/1998 |
| WO | 9939042 | A1 | 8/1999 |
| WO | 0020705 | A1 | 4/2000 |
| WO | 0047841 | A1 | 8/2000 |
| WO | 0063510 | A1 | 10/2000 |
| WO | 0102669 | A1 | 1/2001 |
| WO | 0102670 | A1 | 1/2001 |
| WO | 0145915 | A1 | 6/2001 |
| WO | 0147717 | A1 | 7/2001 |
| WO | 0175247 | A1 | 10/2001 |
| WO | 0188306 | A1 | 11/2001 |
| WO | 03016654 | A1 | 2/2003 |
| WO | 03085222 | A1 | 10/2003 |
| WO | 03087497 | A1 | 10/2003 |
| WO | 2004044348 | A1 | 5/2004 |
| WO | 2004053256 | A1 | 6/2004 |
| WO | 2004101654 | A1 | 11/2004 |
| WO | 2006133690 | A1 | 12/2006 |
| WO | 2007118352 | A1 | 10/2007 |
| WO | 2008060232 | A1 | 5/2008 |
| WO | 2010015516 | A2 | 2/2010 |
| WO | 2010017453 | A2 | 2/2010 |

(56) References Cited

FOREIGN PATENT DOCUMENTS

| | | | |
|---|---|---|---|
| WO | 2012084604 | A1 | 6/2012 |
| WO | 2012126046 | A1 | 9/2012 |
| WO | 2015130169 | A1 | 9/2015 |

* cited by examiner

PANEL AND COVERING

CROSS-REFERENCE TO RELATED APPLICATIONS

This application is a continuation of U.S. patent application Ser. No. 16/606,938 filed Oct. 21, 2019, which is the United States national phase of International Application No. PCT/NL2018/050272 filed Apr. 26, 2018, and claims priority to Dutch Patent Application No. 2018781 filed Apr. 26, 2017, the disclosures of which are hereby incorporated by reference in their entirety.

BACKGROUND OF THE INVENTION

Field of the Invention

The invention relates to an interconnectable panel, in particular a floor panel. The invention also relates to a covering, in particular a floor covering, comprising a plurality of interconnected panels according to the invention.

Description of Related Art

Interconnectable panels, such as interconnectable floor panels, are generally joined mechanically at edges of the panels by using complementary coupling profiles at opposite edges. Traditionally, rectangular floor panels are connected at the long edges by means of a traditional angling method. On the short side, the different coupling mechanisms can be applied, wherein a short edge coupling mechanism may, for example, be based upon vertical folding, also referred to as a drop down, wherein a downward tongue located at a short edge of a panel to be coupled is moved in downward direction, such that said downward tongue is inserted into an upward groove located at a short edge of a panel already installed. An example of such a panel is disclosed in U.S. Pat. No. 7,896,571, wherein a short edge coupling mechanism is shown being configured to vertically lock mutually coupled short edges of adjacent panels. Although this aimed vertical locking effect at the short edges is intended to stabilize the coupling between floor panels at the short edges, in practice often breakages, due to coupling edges being put under tension both during assembly and during practical use, occur at the coupling edges, which affects the reliability and durability of this type of drop down coupling.

A first objection of the invention is to provide an improved panel which can be coupled in improved manner to an adjacent panel.

A second objection of the invention is to provide an improved panel comprising an improved, in particular relatively reliable, drop down coupling mechanism.

A third objection of the invention is to provide an improved panel comprising an improved drop down coupling mechanism, wherein the risk of damaging, in particular breakage of, the drop down coupling mechanism is reduced.

SUMMARY OF THE INVENTION

The panel according to the invention is provided with an improved drop down coupling mechanism with respect to known drop down coupling mechanisms. More in particular, the coupling mechanism is still configured to lock coupled panels both in horizontal and vertical direction due to the presence of the upward tongue having an inclined (inner) side facing toward the upward flank, and due to the presence of an inclined side of the downward tongue facing toward the downward flank, as a result of which the downward tongue will be secured within the upward groove. This first locking mechanism is also referred to as an inner lock. In order to prevent damaging of the profiles and/or in order to realize a coupling between two panels in a relatively controlled (and predictable) manner, the at least one upper elongated slot is applied in the resilient upper bridge part. The elongated slot provided in the upper bridge part typically defines a weakened area (weakened zone) of said upper bridge part, and therefore defines the location of (maximum) material deformation of the bridge part. Due to the resiliency of the (upper) bridge part, in combination with the upper elongated slot position-selectively weakening the bridge part, deformation of said bridge part will take place in a controlled and facilitated manner, which significantly reduces the change of damaging and breaking (parts of) of the coupling parts, which is in favour of the reliability and durability of the connection between the panels, and hence of the panels as such.

The slot is an elongated slot meaning that the slot length is greater than the slot width. Typically, the slot width is small, preferably smaller than or equal to 5 millimetre, more preferably smaller than or equal to 3 millimetre, and most preferably smaller than or equal to 1.5 millimetre. Typically, the slot length is larger than 1.5 millimetre, and commonly larger than 2.5 millimetre. Dependent on the panel thickness and the material used, the slot length may even exceed 5 millimetre. The maximum slot length is limited in order to secure that the bridge parts remains sufficiently strong to stay intact during coupling and uncoupling.

The elongated slot may have a length which is at least two times the width of the slot, preferably at least three times the width of the slot. The elongated slot may be considered a long slit or slot, which function is to locally interrupt the material of the panel to create a weakest, or thinnest, area in the bridge part to facilitate deformation at this weakest, or thinnest, area. Instead of three times, the length may also be at least 2 times the width.

The closed second end of the elongated slot may be rounded. Having a rounded end of the slot may be used to distribute forces exerted on the panel, for instance when walked upon, equally and gradually over the material beneath the slot. A sharp transition for instance would increase the risk of tearing or splitting because peak forces may occurs at the sharp angles of the transition. In particular since the slot typically defines a weakest or thinnest point in the bridge part, the distribution and transmittal of forces, in particular peak forces, prevents the bridge part from locally breaking or failing. Forces exerted on the bridge part are transmitted downwardly towards the rest of the coupling part, preventing peak forces to be exerted on sharp corners or transitions where the slot otherwise would extend.

The bridge part of the second coupling part according to the invention may for instance be understood as (merely) a part of the bridge (also referred to as shoulder) connecting the downward tongue to the core, and being provided with the at least one upper elongated slot. However, the bridge part may also be understood as being the complete bridge connected the downward tongue to the core. The bridge part may be the part of the coupling part which is extending from the top of the downward flank or from the second closed end of the elongated slot, up to the downward tongue. The slot is an elongated slot meaning that the slot length is greater than the slot width. Typically, the slot width is small, preferably smaller than or equal to 5 millimetre, more preferably smaller than or equal to 3 millimetre, and most preferably smaller than or equal to 1.5 millimetre. Typically, the slot length is larger than 1.5 millimetre, and commonly larger than 2.5 millimetre. Dependent on the panel thickness and the material used, the slot length may even exceed 5 millimetre. The maximum slot length is limited in order to secure that the bridge parts remains sufficiently strong to stay intact during coupling and uncoupling. The first coupling part and the second coupling part preferably form an integral part of the core. From a structural, production engineering and logistics viewpoint this integral connection between the core and the coupling parts is generally recommended. However, it is also imaginable that the first coupling part and/or the second coupling part (or parts thereof) are separate components which are connected, for example glued and/or mechanically attached, as separate components to the core.

The slot may have a longitudinal axis having at least a component extending in a direction perpendicular to a (virtual) plane defined by the core. For instance, when the panel is a floor panel lying on a floor which extends horizontally, the slot may have a longitudinal axis having at least a vertical component. The vertical component provides for a local thinning of the bridge part, and thus formation of a weakened area, and preferably the weakest area, of the bridge part, formed in between the (closed) end of the elongated slot and an upper side of the panel. The thinnest part of the second coupling part, measured from the upper side of the panel to the downward groove, is commonly located at the end of the elongated slot. The thinnest part of the second coupling part, measured from the upper side of the panel to the downward groove, is commonly located at the end of the elongated slot. The thinnest part of the second coupling part, measured (as shortest distance) from the upper side of the panel to the (closed) end of the elongated slot, has a thickness which is preferably less than half (50%) the thickness of the core of the panel, in particular less than a third (33%) of the thickness of the core of the panel. At the other hand, the thinnest part of the second coupling part, measured from the upper side of the panel to the (closed) end of the elongated slot, has a thickness which is preferably more than 10% of the thickness of the core of the panel, in particular more than 20% of the thickness of the core of the panel, in order to secure sufficient robustness to the bridge part.

The slot may have a longitudinal axis having a direction with a component extending in a direction perpendicular to the abovementioned plane of the core and a component extending in the direction of the plane of the core, wherein the angle enclosed by the longitudinal axis and the direction perpendicular to the plane of the core lies between 0 and 85 degrees, in particular lies between 25 and 60 degrees, and is in particular is about 45 degrees. For instance, when the panel is a floor panel lying on a floor which extends horizontally, the elongated slot may have a longitudinal axis having at least a vertical component and a horizontal component. The component extending in the direction of the (virtual) plane of the core is preferably directed towards the core of the panel, or is directed inwardly. This will result in an inwardly extending elongated slot. Here, the horizontal component is used to position the (closed) end of the elongated slot inwardly compared to the downward flank, which would elongate the bridge part between the core and the downward tongue. When forces are to be applied to the tongues during coupling, the elongated bridge part creates a longer arm for applying this force, and furthermore limits the amplitude of the deformation (in a direction perpendicular to the plane of the panel). This will be reduce material stress during coupling and uncoupling, which will be in favour of the reliability and durability of the panel connection.

The upper elongated slot may also have a longitudinal axis having a direction with a component extending in a direction perpendicular to the plane of the core and a component extending in the direction of the plane of the core (i.e parallel to the core), wherein the angle enclosed by the longitudinal axis and the upper side of the core lies between 2 and 90 degrees, in particular lies between 25 and 60 degrees, and in particular is about 45 degrees. For instance, when the panel is a floor panel lying on a floor which extends horizontally, the slot may have a longitudinal axis having at least a vertical component and a horizontal component. The component extending in the direction of the plane of the core may for instance be directed towards the core of the panel, or is directed inwardly. The horizontal component may thus be used to place the (closed) end of the elongated slot inwardly compared to the downward flank. This elongates the bridge part between the core and the downward tongue. When forces are to be applied to the tongues during coupling, the elongated bridge part creates a longer arm for applying this force, and furthermore limits the amplitude of the deformation (in a direction perpendicular to the plane of the panel).

The longitudinal axis of the slot may be directed towards the direction perpendicular to the plane of the core, such that the direction perpendicular to the plane defined by the core and the longitudinal axis intersect. This way, the slot is, from its open end to its closed end, directed towards the core of the panel, which results in an inward direction of the slot. By directing the slot inwardly, the distance between (an upper part of) the core and the downward tongue may be increased, which provides a longer arm for applying a coupling force, and limits the amplitude of the deformation, and hence limits material stress during coupling and/or uncoupling. The open first end of the slot may be arranged at the transition between the bridge part and the core, or at the transition between the bridge part and the downward flank. By providing the slot at the transition, the slot may be used to prolong, or elongate, the bridge part.

At least a part of a side of the upward tongue facing toward the upward flank may form an upward aligning edge for the purpose of coupling the first coupling part to a second coupling part of an adjacent panel. The aligning edge aids in the mutual alignment of two panels (to be coupled). This aligning edge may help to guide the downward tongue towards the upward groove, which groove initially is too narrow to allow insertion of the downward tongue, before deformation of the upper bridge part. The upward aligning edge is preferably flat (non-curved and non-profiled) and/or inclined to provide an improved sliding surface.

At least a part of a side of the upward tongue facing away from the upward flank may be provided with a first locking element, and the downward flank may be provided with a second locking element, wherein each locking element may be adapted to co-act with another locking element of an adjacent panel. The locking elements may be used to provide a locking against vertical and/or rotational uncoupling of two coupled floor panels. In another embodiment variant the first locking element comprises at least one outward bulge, and the second locking element comprises at least one recess, which outward bulge is adapted to be at least partially received in a recess of an adjacent coupled floor panel for the purpose of realizing a locked coupling. This embodiment variant is generally advantageous from a production engineering viewpoint. The first locking element and the second locking element preferably take a complementary form, whereby a form-fitting connection of the locking elements of adjacent floor panels to each other will be realized, this enhancing the effectiveness of the locking.

In an embodiment of the floor panel according to the invention the first locking element is positioned at a distance from an upper side of the upward tongue. Positioning the first locking element at a distance from the upper side of the upward tongue has a number of advantages. A first advantage is that this positioning of the first locking element can facilitate the coupling between adjacent floor panels, since the first locking element will be positioned lower than (a lower part of) the aligning edge of the upward tongue, whereby the coupling between two coupling parts can be performed in stages. During the coupling process the tongue sides facing toward the associated flanks will first engage each other, after which the locking elements engage each other, this generally requiring a less great maximum pivoting (amplitude), and thereby deformation of a second coupling part of an adjacent floor panel, than if the first aligning edge and the first locking element were to be located at more or less the same height. A further advantage of positioning the first locking element at a distance from an upper side of the upward tongue is that the distance to the resilient connection between each coupling part and the core, generally formed by the resilient bridge of each coupling part, is increased, whereby a torque exerted on the coupling parts can be compensated relatively quickly by the locking elements, which can further enhance the reliability of the locking.

The elongated slot may be provided with an elastic insert, such as a rubber insert. Such elastic insert may be used to provide a waterproof seal between the coupling parts in coupled condition. The insert may also be used to prevent closing of the elongated slot through deformation of the bridge part, which insert does not impede opening of the elongated slot through deformation. This way, unintentional closing and thus hindering of coupling of two panels, can be prevented. In coupled condition, the elongated slot may be essentially free of (tongue) material of another panel, which prevents hindering of deformation of the bridge part. The insert may for instance be formed of silicon, (natural) rubber, EPDM, PU, PVC, or a thermoplastic material. Preferably, the elastic insert co-acts in a sealing manner with an upward tongue of an adjacent panel (in coupled condition).

The open first end of the elongated slot may be located at a distance from both the downward flank and the downward tongue. More in particular the open end of the elongated slot may be situated in between the top of the downward flank and a position halfway between the top of the downward flank and the side of the downward tongue facing toward the downward flank. The open end of the elongated slot may thus be located on the first half of the bridge part closest to the core of the panel. By having the open end of the slot relatively close to the core of the panel, the length of the coupling part following the slot towards the outside is also relatively large, which provides a relatively long arm facilitating deformation of the bridge part of the second coupling part.

A lower side (lower surface) of the bridge part of the second coupling part defining an upper side (upper surface) of the downward groove may be at least partially inclined, and preferably extends downward towards the core of the panel. The upper side (upper surface) of the upward tongue may, as well, be at least partially inclined, wherein the inclination of this upper side of the upward tongue and the inclination of the bridge part of the second coupling part may be identical, though wherein it is also imaginable that both inclinations for instance mutually enclose an angle between 0 and 5 degrees. The inclination of the bridge part of the second coupling part creates a natural weakened area of the bridge part, where deformation is likely to occur. This weakened area may for instance be the location where the elongated slot is provided, which increases or enlarges the weakened area. Alternatively, the slot may be provided on a different location, to distribute weakened zones over the bridge part and distribute deformation over the bridge part. This decreases the chances of the bridge part being damaged or fails upon coupling of the panels.

The first coupling part may also comprise a resilient lower bridge part connecting the upward tongue to the core of the panel, wherein the bridge part may be configured to deform during coupling of the panels, to widen the upward groove temporarily, facilitating introduction of the downward tongue in the widened upward groove, and said lower bridge part may be provided with at least one lower elongated slot, wherein the elongated slot may have an open first end connecting to the upward groove, and a closed second end, wherein the second closed end may define a weakened area, preferably the weakest area, of said lower bridge part, such that deformation of the bridge is facilitated at that location of the slot. Similarly to the upper bridge part of the second coupling part, the lower elongated slot on the first coupling part serves a similar purpose. It is imaginable that, at least in an uncoupled condition and possibly also in a coupled condition, at least a part of the first coupling part is situated at a higher level than the lower side of the panel (facing the core). Here, at least a part of the first coupling part be inclined upwardly in uncoupled condition, which may additionally facilitate bending down (downward deformation) during coupling, leading to less material stress both in the first coupling part (of a first panel) and the second coupling part (of a second panel) during coupling. In an embodiment of the panel according to the invention, it is imaginable that the lower bridge part (of the first coupling element) is provided with at least lower elongated slot, while the upper bridge part (of the second coupling element) is not provided with an upper elongated slot.

The panel may be elongated, in particular rectangular, wherein the first and second coupling parts are provided on the short sides of the panel. On the long sides of the panel in that case typically an angling in profile is present. Coupling of panels, and floor panels in particular, is typically done by angling a new panel in a groove of an existing, already laid, panel. Difficulty in these situations lies in providing a relatively strong connecting on the short sides of the panels, which is preferably obtained during the same angling motion along the long sides. In that case, first and second coupling parts can be configured to be coupled with a zipping motion, wherein the first and second coupling parts are particularly configured to be coupled during an angling movement on one of the long sides of the panel.

Alternatively, the panel may be elongated, wherein the first and second coupling parts are provided on the long sides of the panel, and wherein the first and second coupling parts are configured to be coupled with a zipping motion, wherein the first and second coupling parts are particularly configured to be coupled during an angling movement on one of the short sides of the panel.

In an embodiment a plurality of sides of the floor panel comprise the first coupling part, and a plurality of other sides of the floor panel comprise the second coupling part. Each first coupling part and each second coupling part are preferably situated on opposite sides of the floor panel. By positioning the first coupling part and the second coupling part on opposite sides it will be relatively simple for a user to lay a floor formed by floor panels according to the invention, since each floor panel can be formed in the same way. However, it is also conceivable that a first coupling part is situated on a side of the panel, wherein a second coupling part is situated on an adjacent side of said panel. In this way each side of the floor panel can be provided with a (first or second) coupling part, this increasing the coupling options of the floor panel. Each panel can have exactly the same configuration. However, it is also imaginable that different types of panels according to the invention, for example a first type A and a second type B, are used. The two types are in this embodiment identical except that the location of the coupling parts is mirror-inverted. Several variants may be used. The two types of panels need not be of the same format, and the coupling parts can also be of different shapes provided that they can be joined. Hence, this may lead to a flooring according to the invention, comprising two (or more) different types of floorboards (A and B respectively), wherein the Coupling part of one type of floorboard (A) along one pair of opposite edge portions are arranged in a mirror-inverted manner relative to the coupling parts along the same pair of opposite edge portions of the other type of floorboard (B).

The (floor) panel according to the invention is primarily intended for so-called laminated floors, but generally it can also be applied for other kinds of covering, consisting of hard floor panels, such as veneer parquet, prefabricated parquet, or other floor panels which can be compared to laminated flooring. Hence, the floor panel according to the invention is preferably a laminated floor panel. A laminated floor panel is considered as a floor panel comprising multiple material layers. A typical laminated floor panel comprises at least one central core layer, and at least one further layer attached to either at a bottom surface and/or top surface of said core layer. A backing layer attached to at least a part of a bottom surface is also referred to as a balancing layer. This backing layer commonly covers the core of the panel, and optionally, though not necessarily, one or more edges of the panel. On top of the core, commonly one or more additional layers are applied, including at least one design layer (decorative layer) which is preferably covered by a substantially transparent protective layer. The decorative layer may be formed by a paper layer onto which a decorative pattern is printed, though it is also thinkable that the decorative design is directly printed onto the core or onto a core coating. The protective layer may have a profiled top surface, which may include an embossing which corresponds to the decorative pattern (design) visualised underneath the protective layer, to provide the floor panel an improved feel and touch. Different materials may be used for the layers. The core, for example, can be formed of a MDF or HDF product, provided with a protective layer. The core could also be formed of a synthetic material, such as a thermoplastic like polyvinyl chloride (PVC), and/or a thermoplastic material which is enriched with one or more additives. The thermoplastic material may be fibre reinforced and/or dust reinforced, and may be part of a composite material to be used as core material. To this end, a dust-(thermo)plastic-composite may be used as core material. The expression "dust" is understood is small dust-like particles (powder), like wood dust, cork dust, or non-wood dust, like mineral dust, stone powder, in particular cement. By combining bamboo dust, wood dust, or cork dust, or combination thereof, with for example high density polyethylene (HDPE), or polyvinylchloride (virgin, recycled, or a mixture thereof), a rigid and inert core is provided that does not absorb moisture and does not expand or contract, resulting in peaks and gaps. An alternative material which may be used to manufacture at least a part of the floor panel according to the invention, in particular the core layer, is at least one mineral, ceramics and/or cement. Instead of a laminated floor panel, the floor panel according to the invention may also be formed by a single layer floor panel, which may for example be made of wood.

The panel according to the invention can also be applied to form an alternative covering, for example a wall covering or a ceiling covering.

BRIEF DESCRIPTION OF THE DRAWINGS

The invention will be elucidated on the basis of non-limitative exemplary embodiments shown in the following figures. Herein.

DESCRIPTION OF PREFERRED EMBODIMENTS OF THE INVENTION

Figure 1:
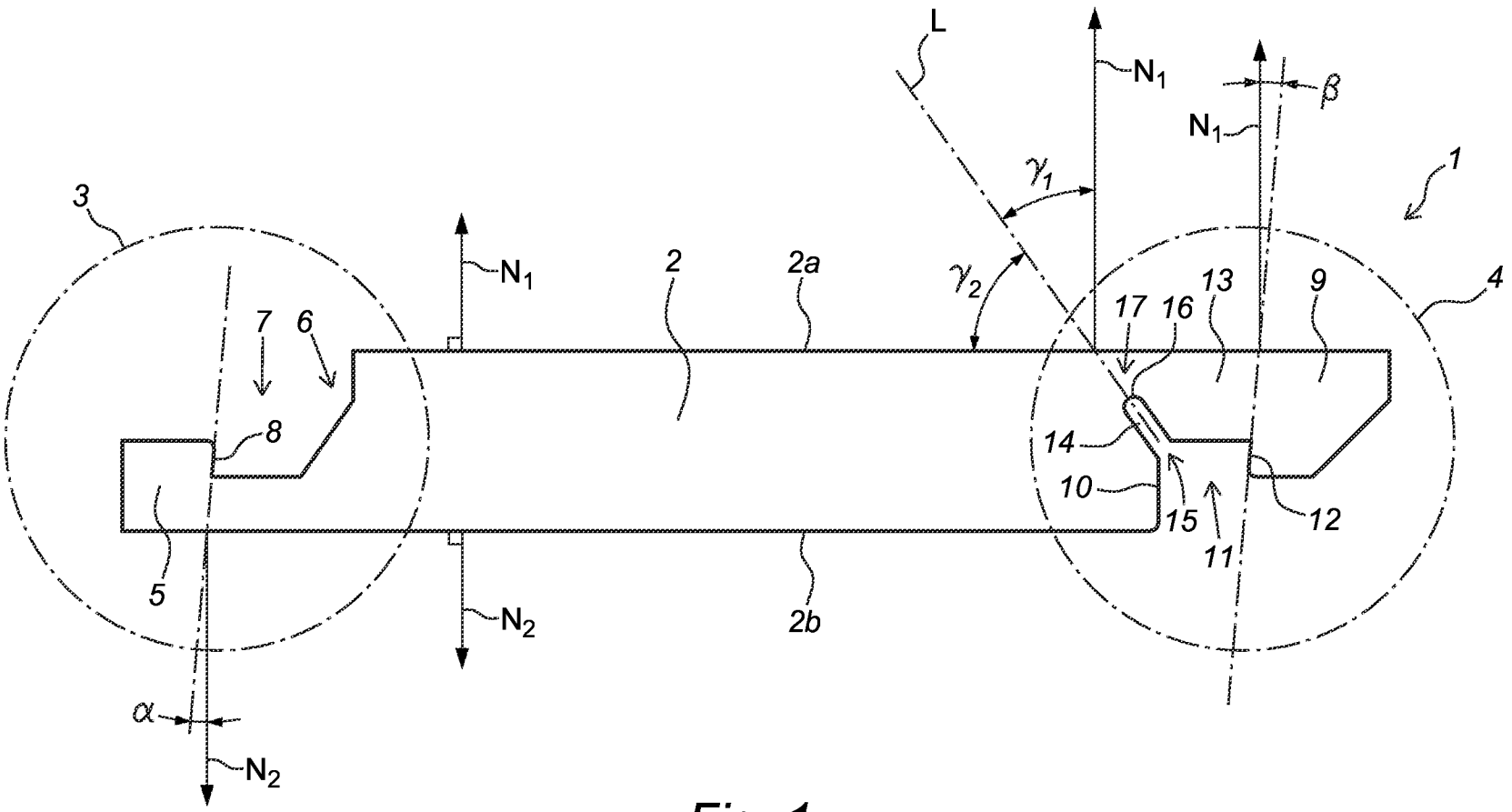
FIG. 1 schematically shows a panel according to the present invention.

FIG. 1 schematically shows a panel (1), comprising a centrally located core (2) provided with an upper side (2*a*) and a lower side (2*b*), which core defines a plane. The panel (1) is further provided with a first coupling part (3) and second resilient coupling part (4) connected respectively to opposite edges of the core (2). The first coupling part (3) comprises an upward tongue (5), an upward flank (6) lying at a distance from the upward tongue (5) and an upward groove (7) formed between the upward tongue (5) and the upward flank (6) wherein the upward groove (7) is adapted to receive at least a part of a downward tongue (9) of an adjacent panel (1). A part of a side (8) of the upward tongue (5) facing toward the upward flank (6) extends towards the core (2) of the panel (1). The angle (a) enclosed by on the one hand the direction in which the side (8) of the upward tongue (5) extends and on the other a direction (N1, N2) perpendicular to the plane of the core (2) lies between 1 and 5 degrees. The direction perpendicular to the plane of the core (2) is defined by the upper normal (N1) and the lower normal (N2) of the core (2).

The second coupling part (4) comprises a downward tongue (9), a downward flank (10 lying at a distance from the downward tongue (9) and a downward groove (11) formed between the downward tongue (9) and the downward flank (10), wherein the downward groove (11) is adapted to receive at least a part of an upward tongue (5) of an adjacent panel (1). A part of a side (12) of the downward tongue (9) facing toward the downward flank (10) extends towards the core (2), The angle ((3) enclosed by on the one hand the direction in which the side (12) of the downward tongue (9) extends and on the other a direction (N1, N2) perpendicular to the plane of the core (2) lies between 1 and 5 degrees. The direction perpendicular to the plane of the core (2) is defined by the upper normal (N1) and the lower normal (N2) of the core (2).

The second coupling part (4) comprises a resilient bridge part (13) connecting the downward tongue (9) to the core (2) of the panel (1), wherein the bridge part (13) is configured to deform during coupling of adjacent panels (1), to widen the downward groove (11), facilitating introduction of the upward tongue (5) in the widened downward groove (11). The bridge part (13) is thereto provided with an elongated slot (14), wherein the elongated slot (14) has an open first end (15) connecting to the downward groove (11), and a closed second end (16), wherein the closed second end (16) defines a weakest area (17) of said bridge part (13), where the bridge part (13) has the smallest (material) thickness, such that deformation of the bridge (13) is facilitated at that location of the slot (14), in particular the location of the closed second end (16) of the slot (14).

The slot (14) in FIG. 1 has a longitudinal axis (L) having a direction with a component in a direction (N1) perpendicular to the plane of the core (2) and a component in the direction of the plane of the core (2), wherein the angle (γ1) enclosed by the longitudinal axis (L) and the direction (N1) perpendicular to the plane of the core (2) is about 45 degrees. In FIG. 1, the upper side (2*a*) of the core (2) is flat, such that the angle (γ1) enclosed by the longitudinal axis (L) and the upper side (2*a*) of the core also is about 45 degrees.

Figure 2:
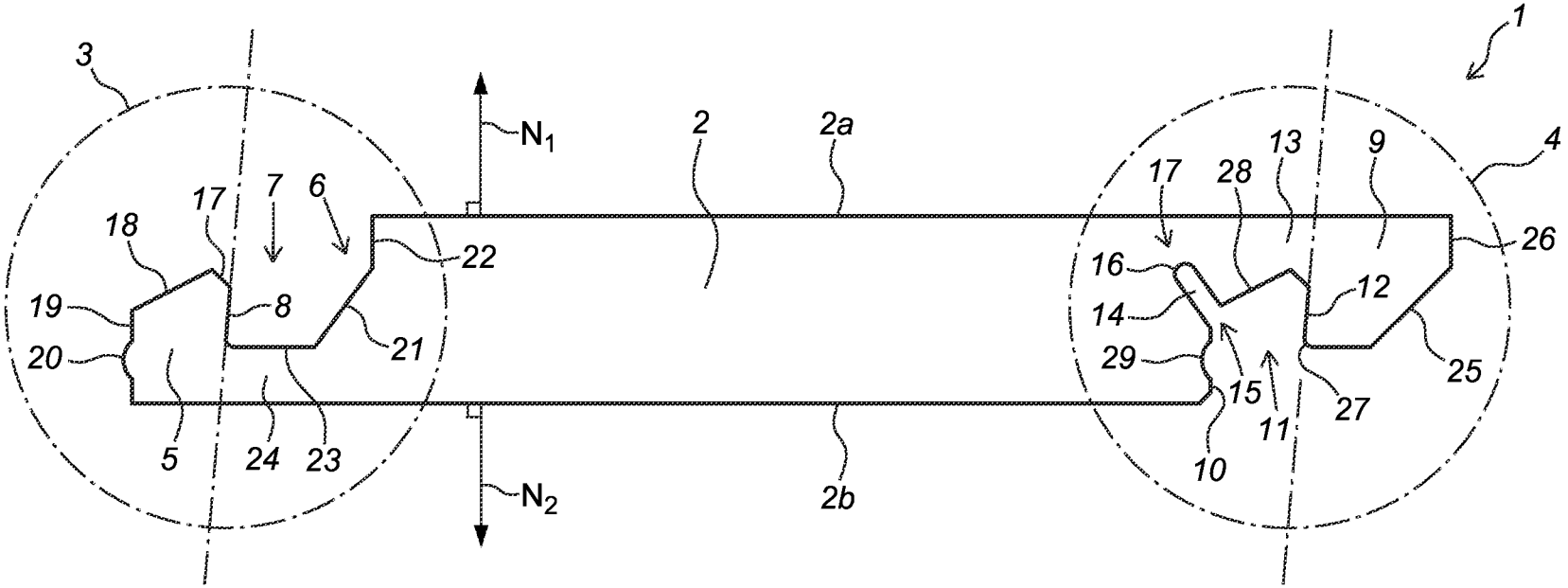
FIG. 2 schematically shows a panel according to the present invention.

FIG. 2 schematically shows the panel of FIG. 1, wherein the coupling parts (3, 4) are embodied slightly different. Another side (17) of upward tongue (5) facing toward upward flank (6) forms an aligning edge (17) enabling facilitated realization of a coupling to an adjacent panel (1). As shown, this side (17) functioning as aligning edge (17) is directed away from the normal N1 of upper side (2*a*) of the core (2). An upper side (18) of upward tongue (18) extend in the direction of the normal N1 of upper side (2*a*) of core (2), and runs inclining downward in the direction of the side (19) of upward tongue (5) facing away from upward flank (6). This chamfering provides the option of giving the complementary second coupling part (4) a more robust and therefore stronger form. The side (19) of upward tongue (5) facing away from upward flank (6) is oriented substantially vertically and is moreover provided with a locking element (20), shown as an outward bulge (20). A lower part (21) of upward flank (6) is oriented diagonally, while an upper part (22) of upward flank (6) is shown to be substantially vertical and forms a stop surface for second coupling part (4). A lower wall part (23) of upward groove (7) is oriented substantially horizontally in this exemplary embodiment. A bridge (24) lying between lower wall part (23) of upward groove (7) and a lower side (2*b*) connects the upward tongue (5) and the core (2).

A side (25) facing away from downward flank (10) is diagonally oriented, but may have a flatter orientation than the complementary side (21) of upward flank (6), whereby a gap (air space) will be formed in the coupled position. The inclining side (25) of downward tongue (9) also functions as aligning edge (25) for the purpose of further facilitating coupling between two panels (1). Another side (26) facing away from downward flank (10) takes a substantially vertical form and forms a complementary stop surface (26) to the stop surface (22) of upward flank (6) of an adjacent panel (1). Downward tongue (9) is further provided with a side (27) which is facing toward downward flank (10) and which functions as aligning edge (27) for first coupling part (3) of an adjacent panel (1). Because upper side (18) of upward tongue (5) has an inclining orientation, an upper side (28) of downward groove (11) has a similar inclining orientation, whereby the (average) distance between upper side (28) of downward groove (11) and an upper side (18) of second coupling part (4) is sufficiently large to impart sufficient strength to second coupling part (4) as such. Downward flank (10) is oriented substantially vertically and is provided with a locking element (29), embodied as a recess (29) adapted to receive the outward bulge (20) of the upward tongue (5) of an adjacent panel (1).

Figure 3:
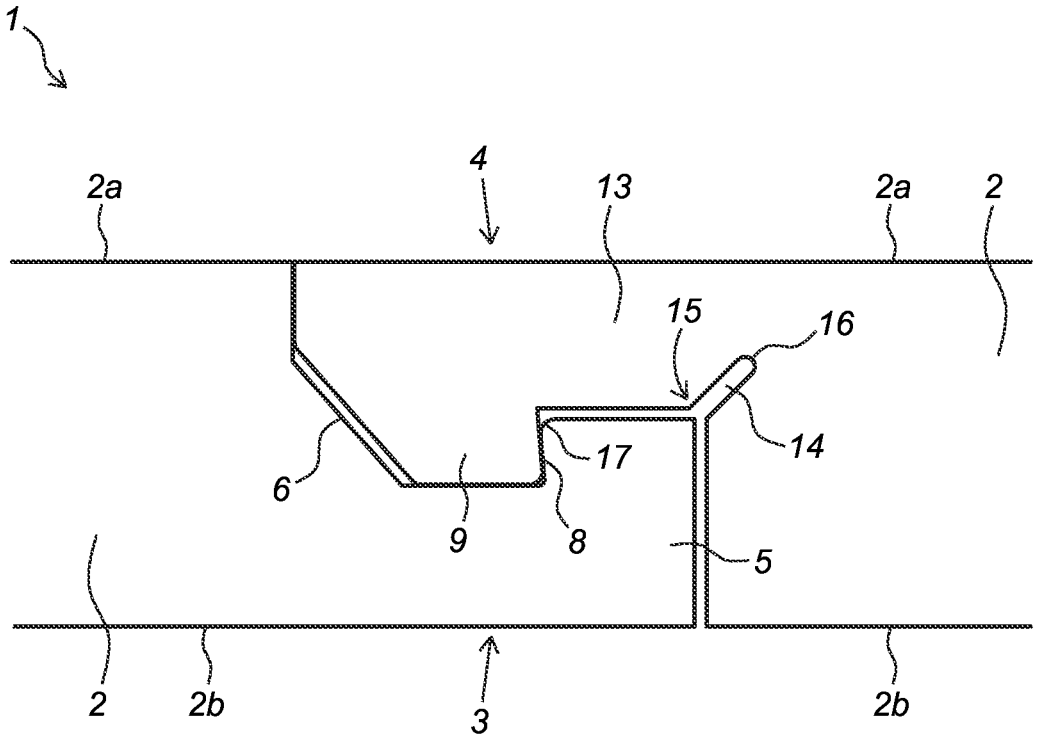
FIG. 3 schematically shows the coupling parts of two panels in coupled condition according to the present invention.

FIG. 3 schematically shows the coupling parts (3, 4) of two panels as shown for instance in FIG. 1, in coupled condition. The elongated slot (14), in coupled condition, is free of any material of the tongues (5, 9).

Figure 4A:
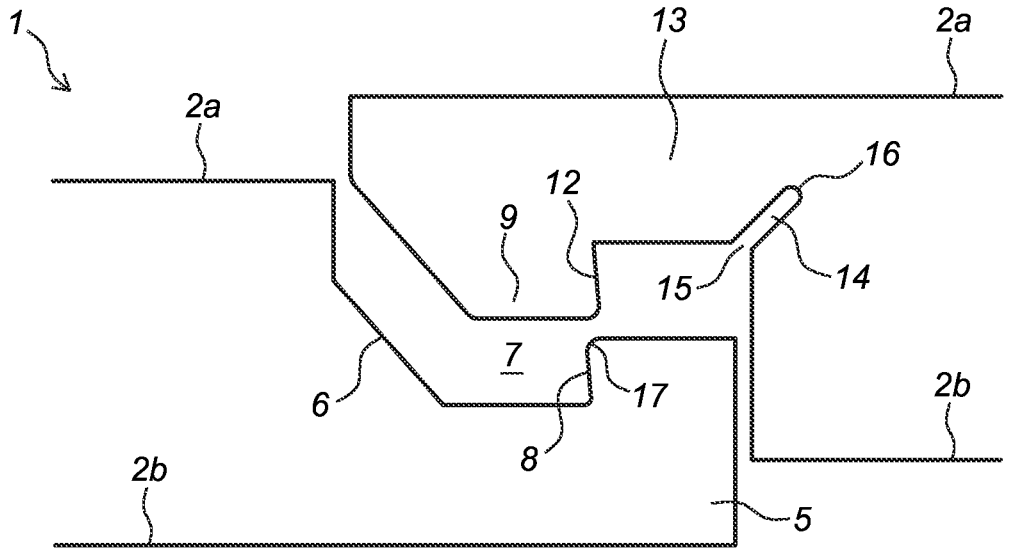
FIGS. 4A-4C schematically show the coupling of two coupling parts according to the present invention.
Figure 4B:
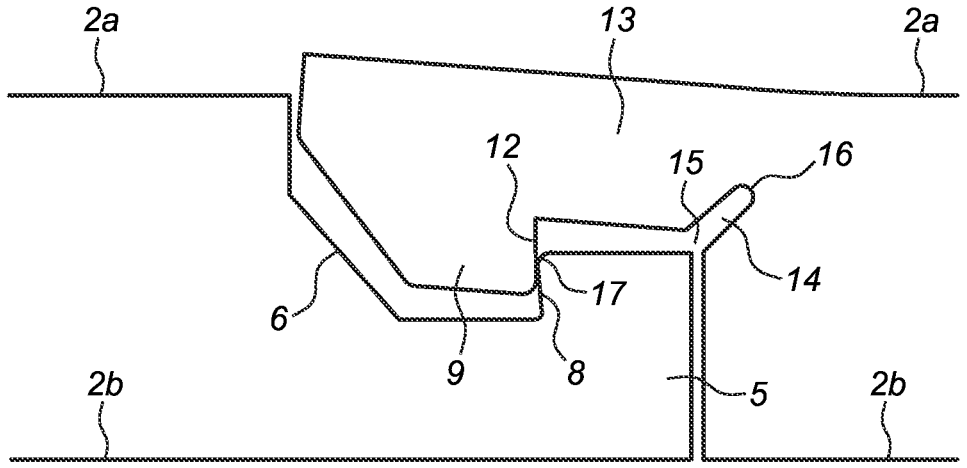
Figure 4C:
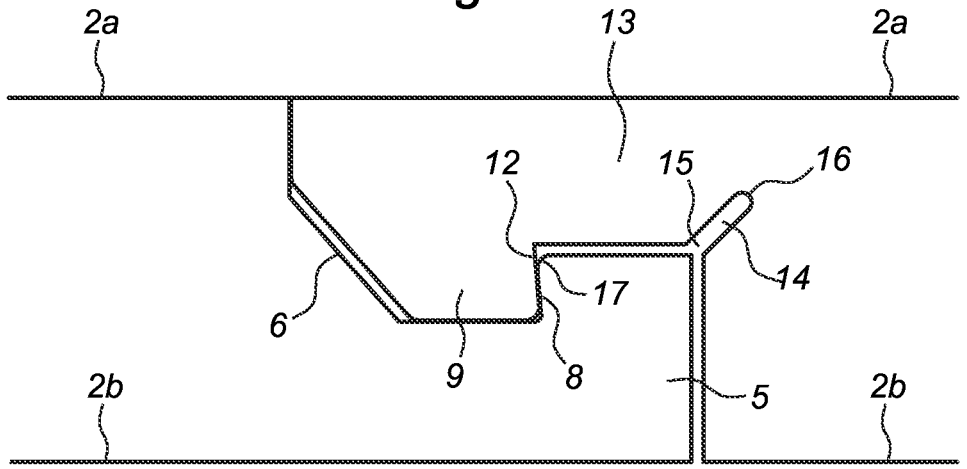

FIGS. 4A-4C schematically show the coupling of two coupling parts, for instance as shown in FIG. 1 or 3. In FIG. 4A, two adjacent panels (1) are close together, but uncoupled. The downward tongue (9) of one panel (1) is located above the upward groove (7) of another panel (1). Since the side (8) of the upward tongue (5) facing towards the upward flank (6) is directed towards the core (2), or inwardly, the coupling parts require deformation for coupling.

In FIG. 4B the deformation of the bridge part (13) of the second coupling part of one of the panels (1) is shown. At the location of the closed end (16) of the elongated slot (14) the bridge part (13) is thinnest, and thus weakest. At that location, the bridge part (13) pivots, wherein the downward tongue (9) is turned upwards slightly. This pivots the downward tongue (9) slightly such that the downward tongue (9) can be placed into the upward groove (7). The deformation widens the elongated slot (14), at least temporarily.

In FIG. 4C, the panels (1) are coupled. The elongated slot (14) returned to its original shape and dimension, while the sides (8, 12) of the tongues (5, 9) grip behind each other, forming both a horizontal as vertical locking of the panels (1).

Figure 5A:
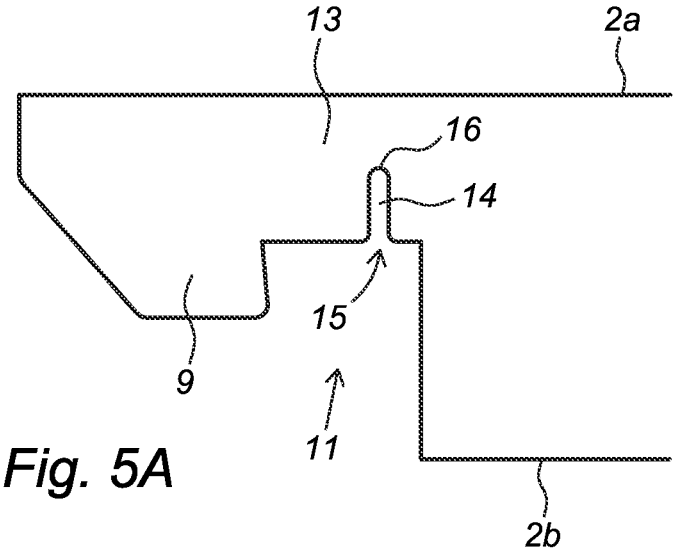
FIGS. 5A-5C schematically show different locations of the elongated slot in a panel according to the present invention.
Figure 5B:
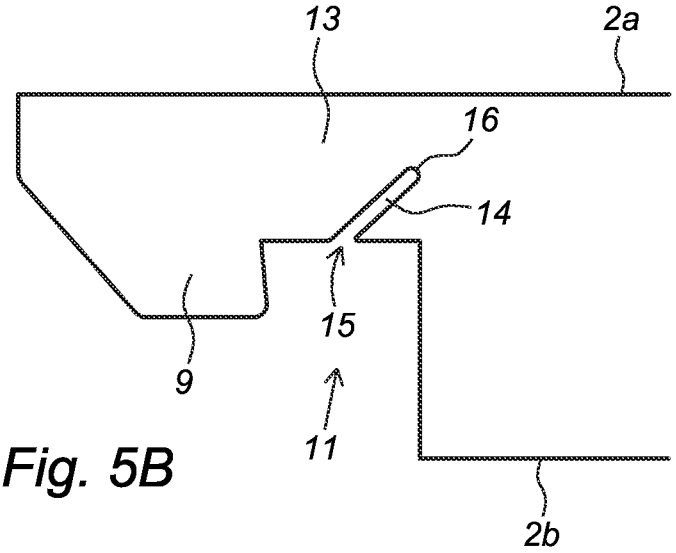
Figure 5C:
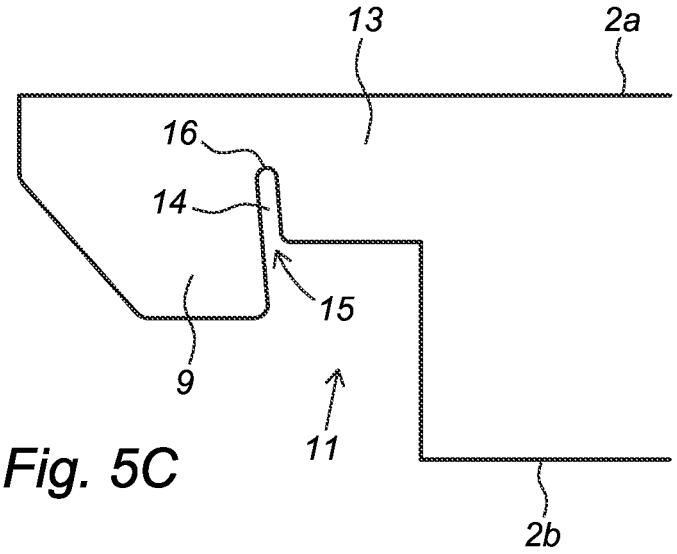

FIGS. 5A-5C schematically show different locations of the elongated slot (14) in a panel (1). In all embodiments the slot (14) is located in the bridge part (13) of the second coupling part of the panel (1).

It will be apparent that the invention is not limited to the working examples shown and described herein, but that numerous variants are possible within the scope of the attached claims that will be obvious to a person skilled in the art.

The above-described inventive concepts are illustrated by several illustrative embodiments. It is conceivable that individual inventive concepts may be applied without, in so doing, also applying other details of the described example. It is not necessary to elaborate on examples of all conceivable combinations of the above-described inventive concepts, as a person skilled in the art will understand numerous inventive concepts can be (re)combined in order to arrive at a specific application.

The verb "comprise" and conjugations thereof used in this patent publication are understood to mean not only "comprise", but are also understood to mean the phrases "contain", "substantially consist of", "formed by" and conjugations thereof.

What is claimed is:

1. A panel, in particular a floor panel, comprising:

a centrally located core provided with an upper side and a lower side, which core defines a plane;

at least one first coupling part and at least one second resilient coupling part connected respectively to opposite edges of the core, which first coupling part comprises a single upward tongue, at least one upward flank lying at a distance from the upward tongue and an upward groove formed in between the upward tongue and the upward flank, wherein the upward groove is adapted to receive at least a part of a downward tongue of a second coupling part of an adjacent panel, wherein:

at least a part of a side of the upward tongue facing toward the upward flank is inclined toward the upward flank, which second coupling part comprises a single downward tongue, at least one downward flank lying at a distance from the downward tongue, and a downward groove formed in between the downward tongue and the downward flank, wherein the downward groove is adapted to receive at least a part of an upward tongue of a first coupling part of an adjacent panel, wherein:

at least a part of a side of the downward tongue facing toward the downward flank is inclined toward the downward flank, wherein the first coupling part comprises a resilient lower bridge part connecting the upward tongue to the core of the panel, wherein the bridge part is configured to deform during coupling of the panels, to widen the upward groove temporarily, facilitating introduction of the downward tongue in the widened upward groove, wherein said lower bridge part is provided with at least one lower elongated slot, wherein the elongated slot has an open first end connecting to the upward groove, and a closed second end, such that a weakened area is formed in said lower bridge part between said closed second end of said lower elongated slot and a lower side of said lower bridge part, facilitating deformation of said lower bridge part.

2. The panel according to claim 1, wherein the second coupling part comprises a resilient upper bridge part connecting the downward tongue to the core of the panel, wherein the bridge part is configured to deform during coupling of adjacent panels, to widen the downward groove, facilitating introduction of the upward tongue into the widened downward groove; and wherein said bridge part is provided with at least one upper elongated slot, wherein the elongated slot has an open first end connecting to the downward groove, and a closed second end, such that a weakened area is formed in said upper bridge part between said closed second end of said elongated slot and an upper side of said upper bridge part, facilitating deformation of said bridge part.

3. The panel according to claim 2, wherein the closed second end of the lower elongated slot and/or the closed second end of the upper elongated slot has a rounded shape.

4. The panel according to claim 1, wherein the closed second end of the lower elongated slot has a rounded shape.

5. The panel according to claim 1, wherein a side of the upward tongue facing toward the upward flank is at least partially curved or rounded, for forming an upward aligning edge for the purpose of coupling the first coupling part to a second coupling part of an adjacent panel.

6. The panel according to claim 5, wherein an upper part of the side of the upward tongue facing toward the upward flank is at least partially curved or rounded.

7. The panel according to claim 1, wherein a side of the downward tongue facing toward the downward flank is at least partially curved or rounded, for forming a downward aligning edge for the purpose of coupling the first coupling part to a second coupling part of an adjacent panel.

8. The panel according to claim 7, wherein an lower part of the side of the downward tongue facing toward the downward flank is at least partially curved or rounded.

9. The panel according to claim 1, wherein the open first end of the upper elongated slot is arranged at the transition between the upper bridge part and the core, or at the transition between the upper bridge part and the downward flank.

10. The panel according to claim 1, wherein the open first end of the lower elongated slot is arranged at the transition between the lower bridge part and the core, or at the transition between the lower bridge part and the upward flank.

11. The panel according to claim 1, wherein the elongated slot has a length which is at least two times the width of the slot.

12. A panel, in particular a floor panel, comprising:

a centrally located core provided with an upper side and a lower side, which core defines a plane;

at least one first coupling part and at least one second resilient coupling part connected respectively to opposite edges of the core, which first coupling part comprises a single upward tongue, at least one upward flank lying at a distance from the upward tongue and an upward groove formed in between the upward tongue and the upward flank, wherein the upward groove is adapted to receive at least a part of a downward tongue of a second coupling part of an adjacent panel, wherein:

at least a part of a side of the upward tongue facing toward the upward flank is inclined toward the upward flank, which second coupling part comprises a single downward tongue, at least one downward flank lying at a distance from the downward tongue, and a downward groove formed in between the downward tongue and the downward flank, wherein the downward groove is adapted to receive at least a part of an upward tongue of a first coupling part of an adjacent panel, wherein:

at least a part of a side of the downward tongue facing toward the downward flank is inclined toward the downward flank, wherein the first coupling part comprises a resilient lower bridge part connecting the upward tongue to the core of the panel, wherein the bridge part is configured to deform during coupling of the panels, to widen the upward groove temporarily, facilitating introduction of the downward tongue in the widened upward groove, wherein the second coupling part comprises a resilient upper bridge part connecting the downward tongue to the core of the panel, wherein the bridge part is configured to deform during coupling of adjacent panels, to widen the downward groove, facilitating introduction of the upward tongue into the widened downward groove;

wherein the material of at least one bridge part of the lower bridge part and the upper bridge part is locally interrupted to form a weak bridge area to facilitate deformation of said bridge part.

* * * * *